US008061070B2

(12) United States Patent
Chamandy

(10) Patent No.: US 8,061,070 B2
(45) Date of Patent: Nov. 22, 2011

(54) GARMENT MARKING CLIP

(75) Inventor: Paul A. Chamandy, Ithaca, NY (US)

(73) Assignee: Avery Dennison Corporation, Pasadena, CA (US)

( * ) Notice: Subject to any disclaimer, the term of this patent is extended or adjusted under 35 U.S.C. 154(b) by 1062 days.

(21) Appl. No.: 11/438,844

(22) Filed: May 23, 2006

(65) Prior Publication Data

US 2007/0283609 A1 Dec. 13, 2007

(51) Int. Cl.
*G09F 3/20* (2006.01)

(52) U.S. Cl. ..... 40/658; 40/661.04; 24/341; 24/555; 24/562

(58) Field of Classification Search ..... 40/658, 40/661.04, 322; 24/3.12, 341, 555, 561, 24/562, 563, 545
See application file for complete search history.

(56) References Cited

U.S. PATENT DOCUMENTS

| | | | | |
|---|---|---|---|---|
| 303,755 | A | 8/1884 | Schwartz | |
| 835,383 | A | 11/1906 | Akerly | |
| 897,476 | A * | 9/1908 | Milliken | 24/562 |
| 1,668,109 | A | 5/1925 | Egan | |
| 1,719,504 | A | 7/1925 | Egan | |
| 2,635,368 | A * | 4/1953 | Greb-Lasky | 38/70 |
| 2,857,696 | A | 10/1956 | Barrow | |
| D192,845 | S | 5/1962 | Cohen | |
| 3,214,813 | A | 11/1965 | Goldman | |
| D218,511 | S | 8/1970 | Sarro | |
| 3,535,808 | A | 10/1970 | Morrish | |
| 3,797,076 | A | 3/1974 | Watkin | |
| 3,962,758 | A * | 6/1976 | Knappe et al. | 24/562 |
| 4,045,899 | A | 9/1977 | Richardson | |
| 4,332,060 | A * | 6/1982 | Sato | 24/67.9 |
| 5,175,913 | A * | 1/1993 | Mackie et al. | 24/562 |
| 5,407,109 | A * | 4/1995 | Zuckerman | 223/85 |
| 5,477,995 | A * | 12/1995 | Dooley et al. | 223/85 |
| 5,495,644 | A | 3/1996 | Mesher et al. | |
| 5,524,801 | A * | 6/1996 | Dooley et al. | 223/85 |
| 5,561,932 | A | 10/1996 | Bracken | |
| 5,590,822 | A * | 1/1997 | Zuckerman | 223/85 |
| 5,611,469 | A * | 3/1997 | Eiley et al. | 223/85 |
| 5,642,840 | A * | 7/1997 | Abdi | 223/85 |
| D382,592 | S | 8/1997 | Maruchi | |
| 5,692,332 | A | 12/1997 | Bracken | |
| D399,527 | S | 10/1998 | Price | |
| 5,970,641 | A | 10/1999 | Bracken, Jr. | |
| 5,992,887 | A | 11/1999 | Maruchi | |
| D443,899 | S | 6/2001 | Stephens | |
| 6,457,218 | B1 | 10/2002 | Lawrence | |
| 6,499,633 | B1 * | 12/2002 | Pogmore | 223/85 |
| 6,915,602 | B2 | 7/2005 | Davis et al. | |
| 6,948,269 | B2 | 9/2005 | Wang | |
| 2003/0101551 | A1 | 6/2003 | Levesque | |
| 2005/0060923 | A1 * | 3/2005 | Ardern, II | 40/658 |
| 2005/0102876 | A1 | 5/2005 | Kelly | |

FOREIGN PATENT DOCUMENTS

| | | |
|---|---|---|
| DE | 31 14671 | 10/1982 |
| EP | 1 168 239 | 1/2002 |

* cited by examiner

*Primary Examiner* — Gary Hoge

(57) ABSTRACT

There are disclosed embodiments of a marking clip for marking garments which may be stacked flat on a surface. The marking clip is generally U-shaped with leg portions joined by a bight portion and is preferably molded of flexible, resilient, plastics material and bears repetitive indicia along the outer surface of the leg and bight portions. Two or more marking clips may be coupled to provide selected combinations.

8 Claims, 6 Drawing Sheets

GARMENT MARKING CLIP

BACKGROUND OF THE INVENTION

1. Field of the Invention

The invention relates to the field of marking garments.

2. Brief Description of the Prior Art

It is known to mark folded garments in stacks by adhesively adhering size strips, wherein the each size strip is adhesively adhered to the folded garment across the fold line and on both sides of the garment as disclosed in U.S. Pat. Nos. 5,561,932; 5,692,332; and 5,970,641. Some garments are comprised of materials that are adversely affected by the adhesive on the strips, for example suede, leather, corduroy, brushed cotton, spandex-containing fabrics and other delicate fabrics. This makes it practically prohibitive to use such adhesive strips on those types of materials. Other prior art disclosures are found in the following U.S. patents: Des. 192,845; Des. 218,511; 303,755; Des. 382,592; Des. 399,527; Des. 433,899; 835, 383; U.S. Pat. Nos. 1,668,109; 1,719,504; 2,857,696; 3,214, 813; 3,535,808; 3,797,076; 4,045,899; 5,495,644; 5,992,887; 6,457,218; 6,915,602; 6,948,269; 6,915,602; and Published Application No. 2003/0101551.

SUMMARY OF THE INVENTION

One embodiment comprises a flexible, resilient clip which can be slipped over the fold line of a folded garment or over the waistband of a garment to mark the garment with the size and/or other features of the garment. These features preferably appear in the form of repetitive occurrences of the same indicia. The clip can have a pair of leg portions and a bight or connecting portion connected to the leg portions in a U-shaped configuration. The inner surface of at least one of the leg portions preferably have one or more frictional members which help keep the clip from slipping off the garment. The end portion of one or both leg portions can be slightly flared apart to facilitate slipping the clip over the folded garment. The indicia can be formed directly on the clip as by printing. Alternatively, a flexible indicia-bearing strip can be applied along the outer surface of the clip. Even when the clip-bearing folded garments are arranged in a stack or on hangers, the indicia are visible because the indicia appear at the bight portion of each clip. The clip is reusable, and even the user can design different indicia-bearing clips on-site because a clip without an indicia strip can have an adhesive strip applied by store personnel, or a clip with an indicia strip can be stripped of its indicia strip and any desired indicia strip can be applied to the clip. Therefore, it is apparent that the inventory of garment marking clips and marking strips can be kept to a minimum.

In another embodiment, clips can be ganged in side-by-side connected relationship. This again keeps the clip inventory to a minimum. The clips can be suitably interlocked, for example, by pins.

The clips can be color coded to indicate differences in the garments, whether the garments are on sale, for date coding and the like. In addition, the marking strips can be color coded differently from the clips with which they are associated.

Merchants keep sets of marking clips bearing various sizes and use them on garments that correspond to those sizes.

BRIEF DESCRIPTION OF THE DIAGRAMMATIC DRAWINGS

DETAILED DESCRIPTION OF THE PREFERRED EMBODIMENTS

Figure 1:
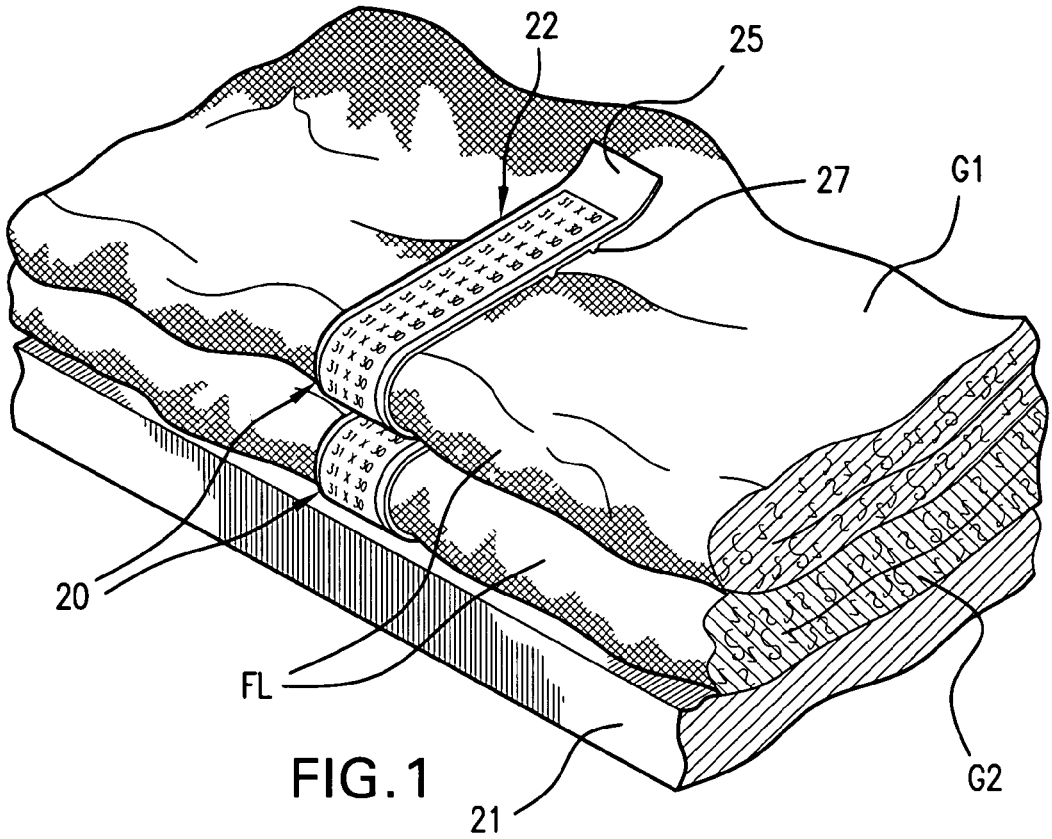
FIG. 1 is a perspective view of a stack of folded garments on a support with an embodiment of marking clips.
Figure 2:
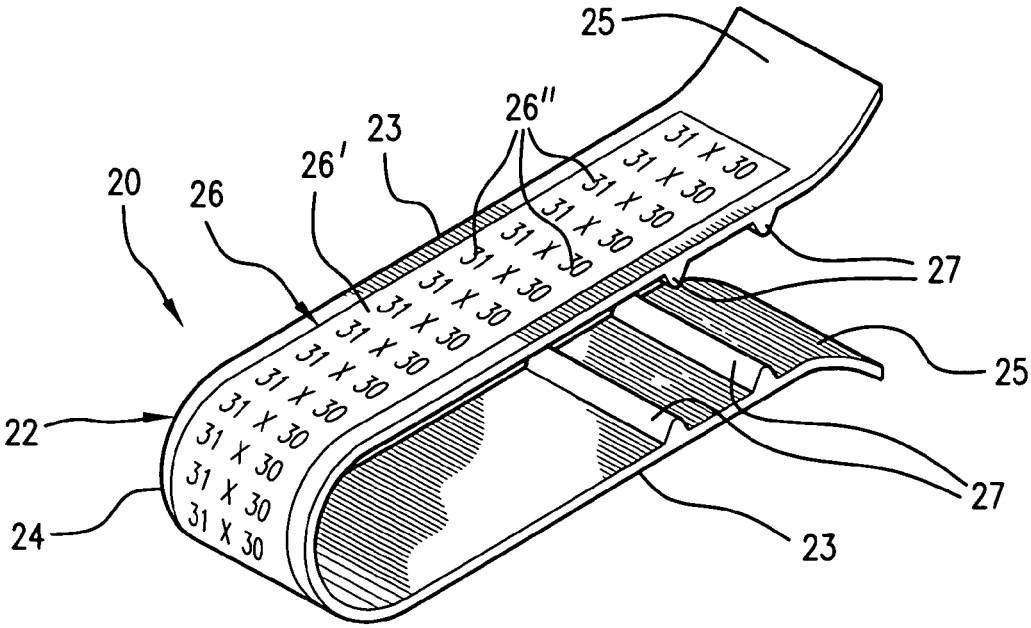
FIG. 2 is a perspective view of one of the marking clips.
Figure 3:
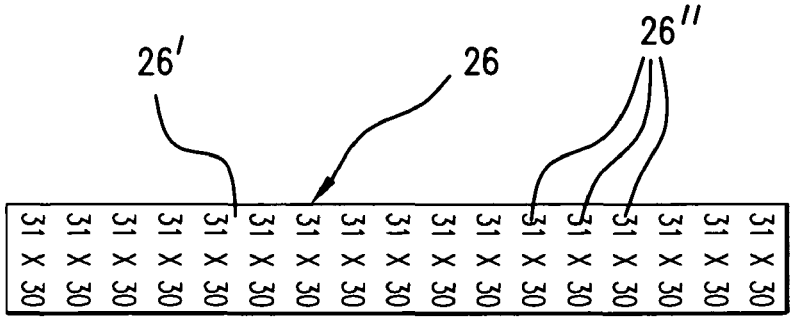
FIG. 3 is a top plan view of a marking strip in a flat state and showing respective indicia along the length of the strip.
Figure 4:
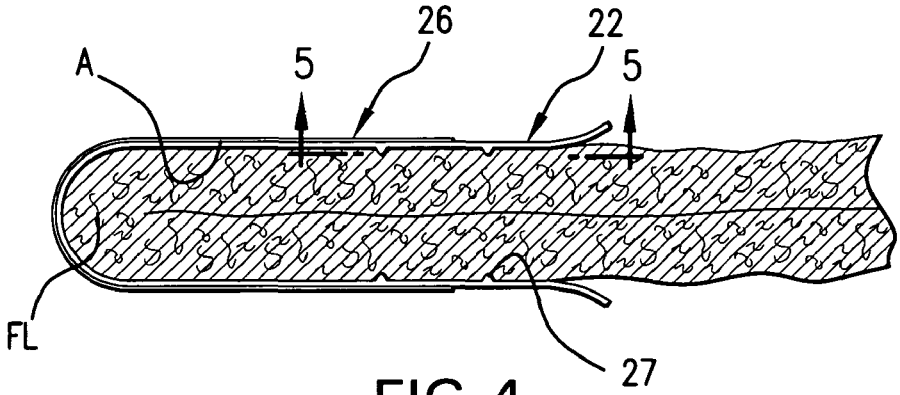
FIG. 4 is a partly sectional view showing the clip and the indicia-bearing strip combination embracing a folded garment.
Figure 5:
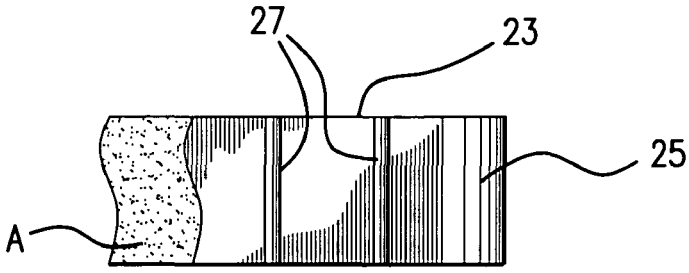
FIG. 5 is a view of a portion of the clip taken generally along line 5-5 of FIG. 4.
Figure 6:
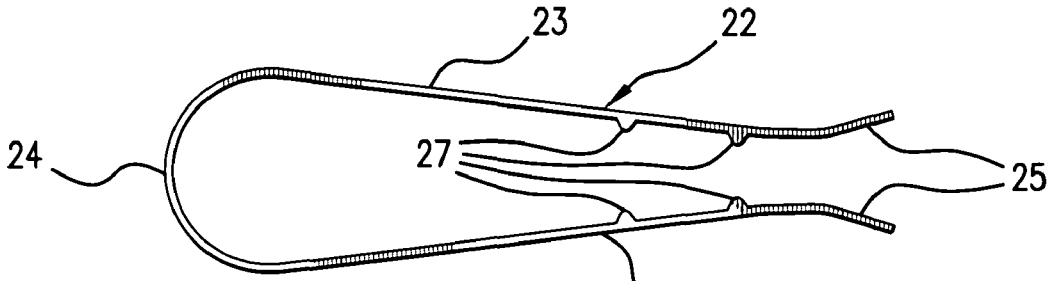
FIG. 6 is an as-molded end elevational view of the clip without the marking strip.

Referring to FIG. 1, there are shown two garment marking clips 20 applied to upper and lower folded sides or layers of stacked respective garments G1 and G2 lying flat on a horizontal support 21. Each marking clip 20 includes a clip 22 of one-piece molded construction preferably composed of flexible, resilient plastics material. Each clip 22 is shown to have a pair of elongate leg portions 23 joined to a bight portion 24. The clip 22 is generally U-shaped. The bight portion 24 is preferably rounded and makes a smooth transition with the leg portions 23. The free end portions 25 of leg portions preferably flare outwardly slightly and extend away from each other to aid in inserting the clip 22 over the folded portion of the garment adjacent fold line FL or over the waistband. A marking strip 26 bearing repetitive indicia, illustrated to be size indicia, is adhesively adhered to the outer surface of the clip 22 along the leg portions and the bight portion 24. A plan view of the marking strip 26 before it has been applied to the clip 22 is illustrated in FIG. 3. The marking strip 26 is preferably comprised of a one-piece sheet or strip of film 26' on which the indicia 26" are printed. While some marking strips may bear size, such as 31×30, others may bear different sizes. The underside of the marking strip 26 has a uniform coating of either removable or permanent adhesive A (FIGS. 4 and 5) which adheres the marking strip 26 to the outer surface of the clip 22. The clip 22 shown in FIG. 6 is in the as-molded condition showing the leg portions 23 converging toward each other away from the bight portion 24. In the as-molded condition, the marking strip 26 is adhesively adhered to the outer surface of the clip 22 to form the marking clip 20. When the marking clip 20 is applied to a garment, the leg portions 23 expand to take on an expanded generally parallel orientation relative to each other as shown in FIGS. 1, 2 and 4. To assist in gripping the garment, the clip 22 preferably has one or more frictional members in the form of grippers 27 preferably on each leg portion 23, shown to be in the form of smooth transverse ridges extending parallel to each other, however, various forms and types of frictional members can be used so long as they do not damage the garment.

The clip 22 is of one-piece molded plastics construction of any suitable material which is flexible and resilient. The clip can be made of transparent, translucent or opaque material or can be clear and colorless. Alternatively, the clip 22 can be of any selected color and some clips 22 in a store's inventory can be in a set of one color and other clips 22 can be in sets of other and different colors. In addition, the film 26' on which the indicia 26" are printed can be of any selected color and the indicia themselves can be of any selected color the same or different from the color of the clip 22. Therefore, a merchant can color code its garment merchandise according to style, source of manufacture, date code, whether or not the garment is on sale, and the like. The clip 22 together with the marking strip 26 as illustrated can constitute the two-part marking clip 20.

The marking clip 20 can alternatively be comprised of the clip 22 printed with repetitive indicia such as the indicia on the marking strip 26, if desired. The color of the printed indicia in combination with the color of the clip 22 on which the indicia are printed can provide a distinguished marking clip 20.

Figure 7:
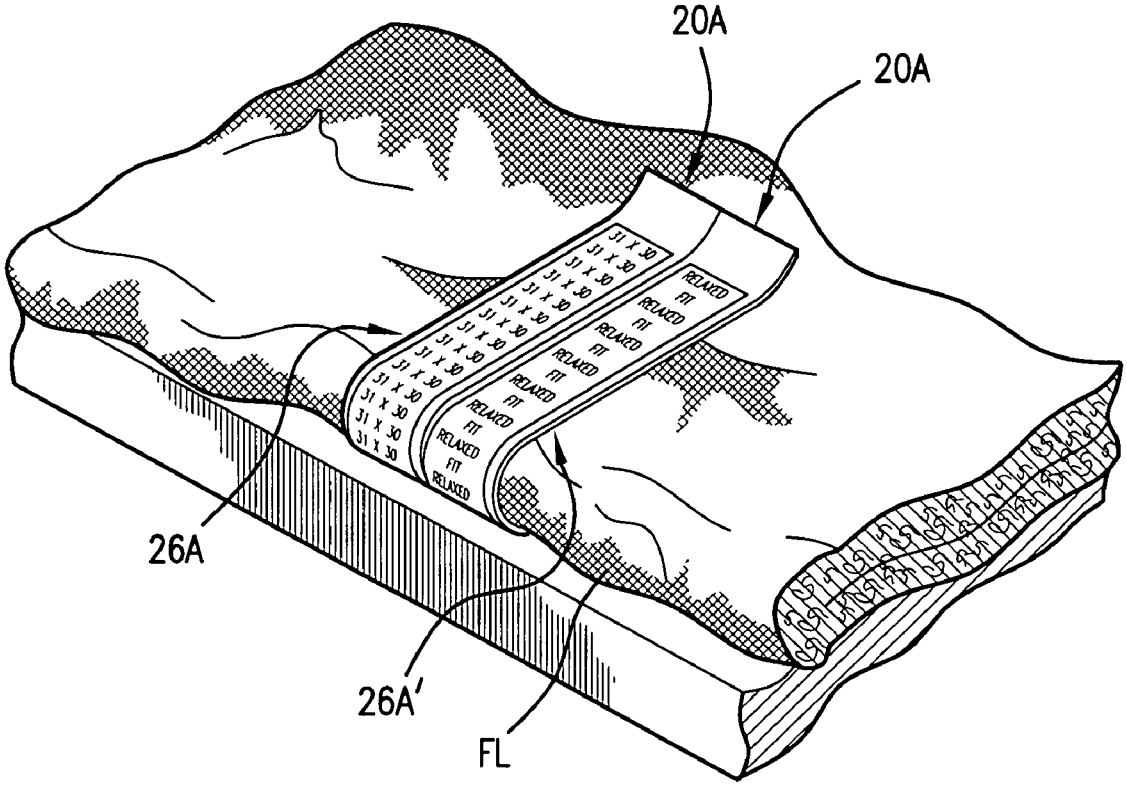
FIG. 7 is a perspective view of a folded garment on a support, wherein ganged clips embrace a garment across a folded portion of the garment.
Figure 8:
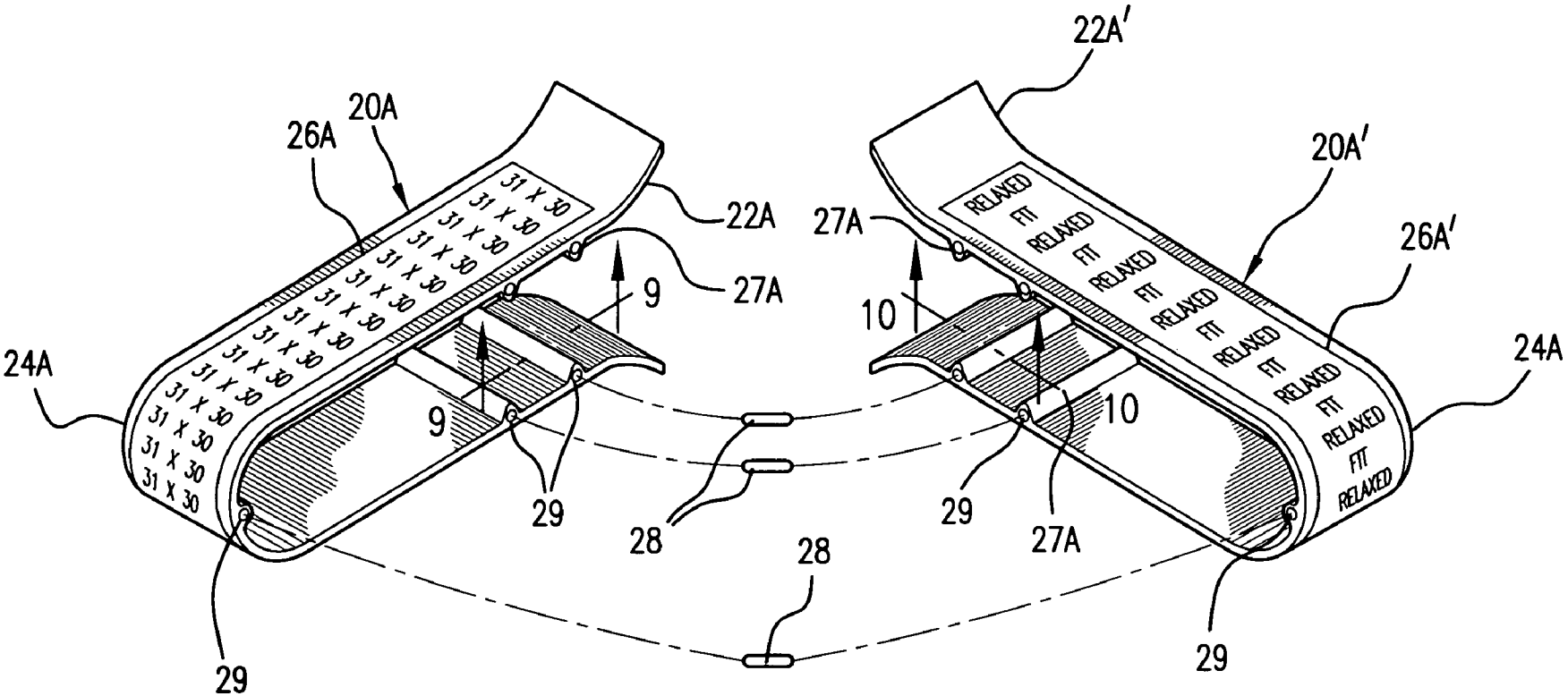
FIG. 8 is an exploded rotated perspective view of a pair of indicia-bearing clips connectable to each other.
Figure 9:
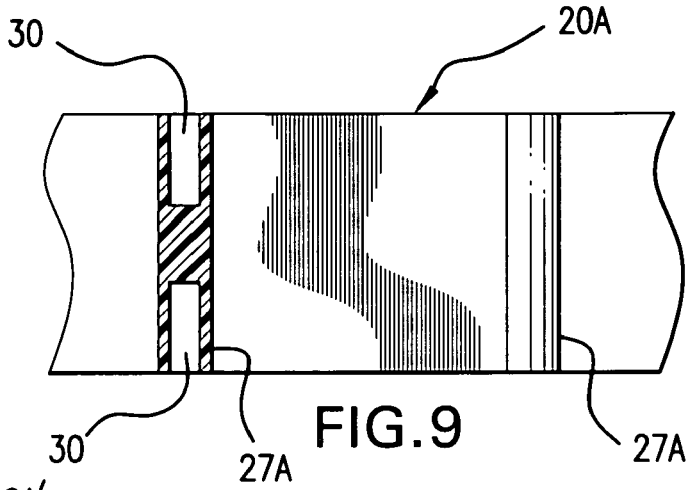
FIG. 9 is a partly sectional view taken generally along line 9-9 of FIG. 8.
Figure 10:
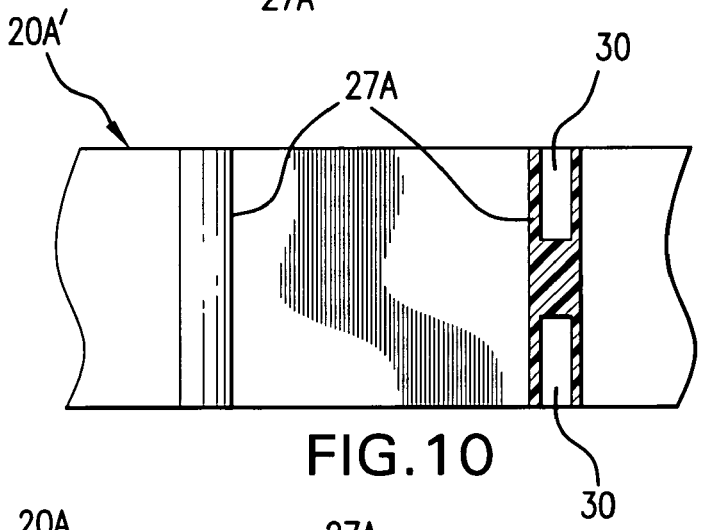
FIG. 10 is a partly sectional view taken generally along line 10-10 of FIG. 8.
Figure 11:
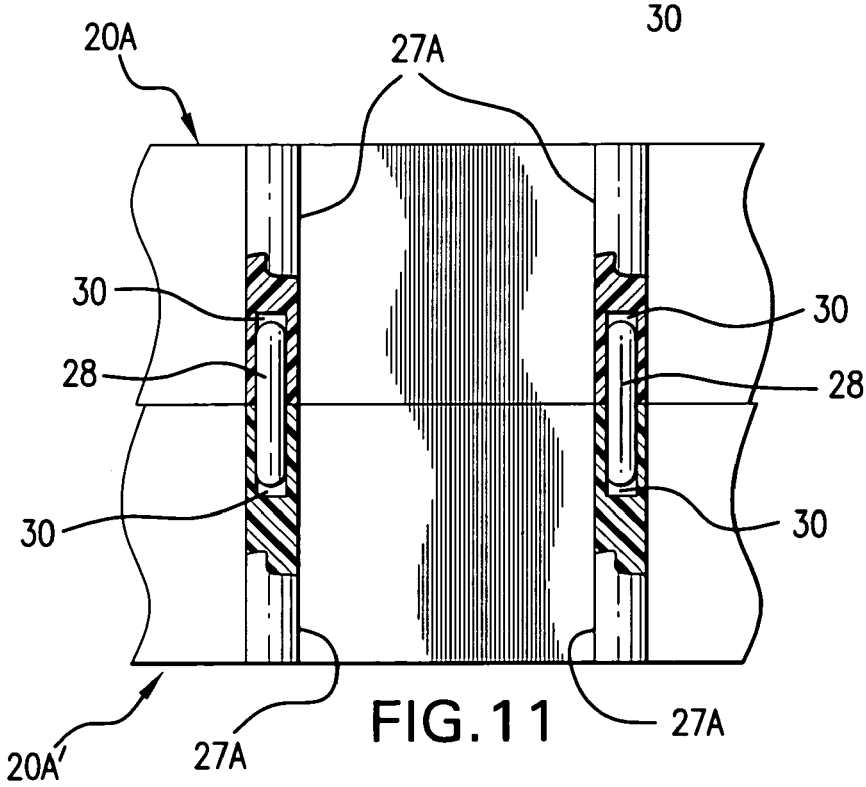
FIG. 11 is a fragmentary view of two side-by-side clips coupled to each other through pins extending into holes in adjacent clips.

With reference to the embodiment of FIGS. 7 through 11, it is shown that multiple marking clips 20A and 20A' can be coupled or ganged to provide a composite marking clip when coupled. The marking clip 20A and the marking clip 20A' are the same as in the embodiment of FIGS. 1 through 7 except they have structures by which two or more clips 20A, 20A' and so on may be coupled to function as a unit as shown in FIG. 7. The frictional members 27A corresponding to frictional members 27 except they can receive round pins 28. One of the pins 28 is received in holes 29 in bight portions of the clips 20A and 20B. FIGS. 9 through 11 show an embodiment of structure for coupling the clips 20A and 20A'. The frictional members 27A have blind round holes 30 that receive the pins 28 which releasably connect the marking clips 20A and 20A1 to each other. For example, the marking clips 20A and 20A' can be paired to provide information which a single clip may not be able to provide. As illustrated, the clip 20A can have repetitive size indicia "31×30" and the clip 20A' can have different indicia such as the illustrated "RELAXED FIT". Like with the marking clip 20, the marking strips 26A and 26A1 can be adhesively adhered to the clips 22A and 22A' or the indicia can be printed directly onto the clips 22A and 22A'. While the merchant would have clips 20A that bear sizes different from 31×30, clips 20A may have other indicia or legends such as "REGULAR FIT".

The coupling of the marking clips 20A and 20A' can be accomplished by various structures other than as illustrated in the drawings, for example, a pin (not shown) molded integrally with one marking clip can fit into a hole of the other marking clip.

The marking clips 20A and 20A' are shown to have the same width or transverse dimension. However, they need not be the same width. For example the marking clip 20A' can be narrower than the marking clip 20A, and vice versa.

Figure 12:
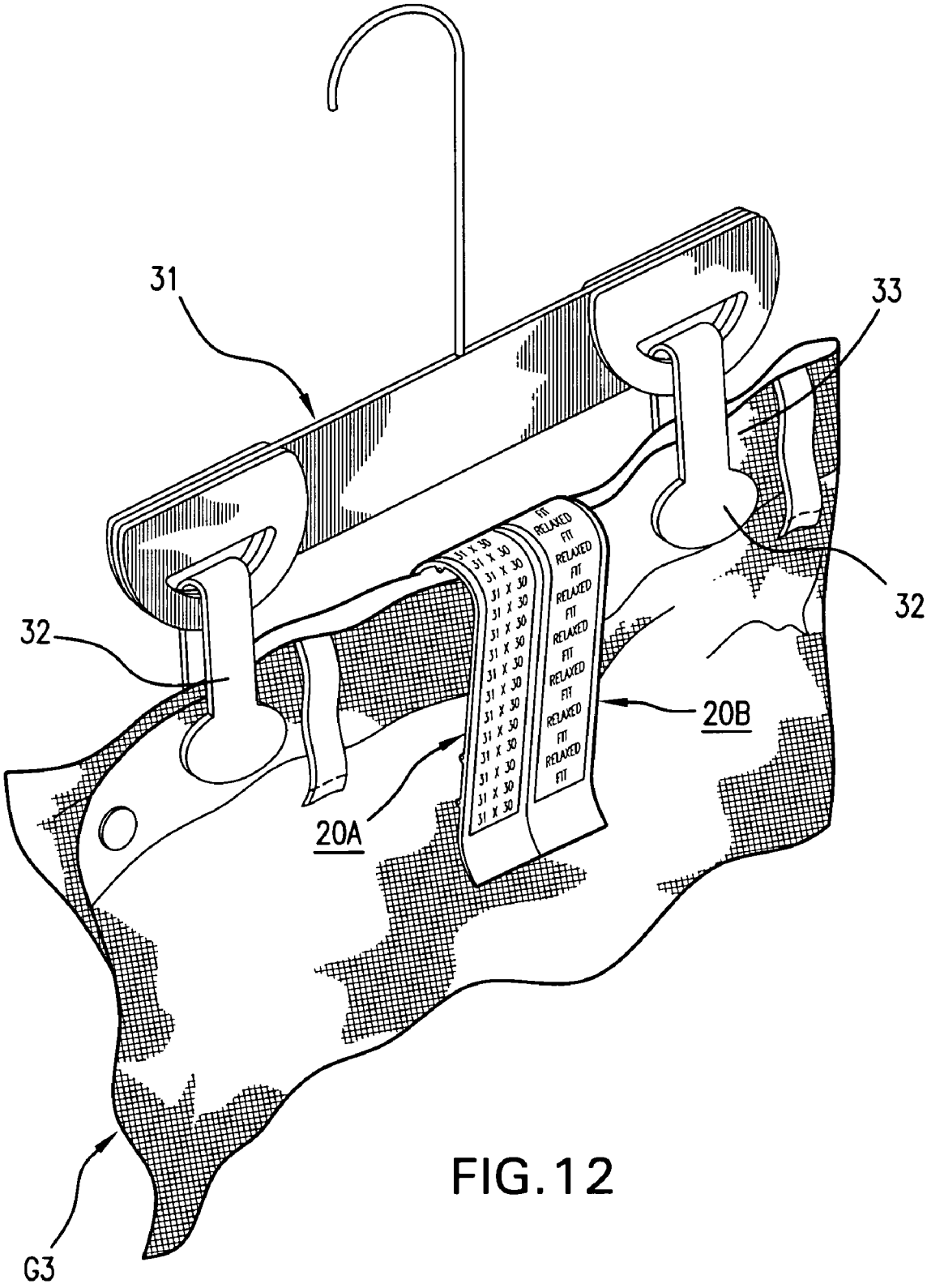
FIG. 12 is a perspective view of a pair of marking clips applied across the waistband of a pair of hanging trousers.

With reference to FIG. 12, there is shown a garment in the form of a pair of trousers folded into two side-by-side layers generally indicated at G3 suspended from a conventional hooked hanger generally indicated at 31. Clasps 32 of the hanger 31 grip the trousers along the waistband 33. A marking clip such as the marking clip 20, or alternatively plural connected clips such as marking clips 20A and 20B as shown in FIG. 12 can be received over the waistband. The garment G3 is gripped by the hanger 31 or any other suitable hanger and the clip 20 or connected clips 20A and 20B can be applied across the waistband of the garment B3. In the event the garment is folded in half and hung vertically on a suitable hanger in an inverted U-shaped arrangement, the clip 20 or connected clips 20A and 20B for example can be slipped vertically downward over the fold line to embrace the garment adjacent the fold line.

Other embodiments and modifications of the invention will suggest themselves to those skilled in the art, and all such of these as come within the spirit of this invention are included within its scope as best defined by the appended claims.

I claim:

1. In combination:

a garment folded about a fold line and having opposite sides, a marking clip including a U-shaped clip having leg portions and a bight portion joining the leg portions, the clip being molded of flexible resilient plastics material, the leg portions converging away from the bight portion in the as-molded condition but spaced apart and being spreadable to embrace the sides of the garment and wherein the bight portion is adjacent the fold line, and size indicia corresponding to the size of the garment appearing repetitively on the outer surface of the clip along the leg and bight portions.

2. The combination defined in claim 1, including a flexible strip containing the indicia on the outer surface of the clip.

3. The combination defined in claim 1, including a flexible strip adhesively adhered to the outer surface of the clip, and wherein the indicia are on the strip.

4. The combination defined in claim 1, wherein there are at least two of such U-shaped clips releasably connectable to each other, each of the clips bearing different indicia.

5. The combination defined in claim 1, wherein adjacent clips are connectable by pins.

6. The combination defined in claim 1, wherein the free end portions of the leg portions are oppositely flared.

7. The combination defined in claim 1, wherein at least one of the leg portions has at least one frictional member facing the garment.

8. The combination defined in claim 1, including sets of clips and/or indicia that are of different selected colors.

* * * * *